United States Patent [19]

Hertz

[11] 3,940,583

[45] Feb. 24, 1976

[54] ARC QUENCHING ARRANGEMENT

[75] Inventor: Walter Hertz, Erlangen-Buckenhof, Germany

[73] Assignee: Siemens Aktiengesellschaft, Munich, Germany

[22] Filed: Mar. 25, 1974

[21] Appl. No.: 454,544

[30] Foreign Application Priority Data

Mar. 30, 1973 Germany ..... 2316009

[52] U.S. Cl. ..... 200/148 A; 200/148 R

[51] Int. Cl.[2] ..... H01H 33/70

[58] Field of Search..... 200/148 A, 150 G, 148 G

[56] References Cited

UNITED STATES PATENTS

| | | | |
|---|---|---|---|
| 1,141,158 | 6/1915 | Turner | 200/148 A |
| 2,051,659 | 8/1936 | Uebermuth | 200/148 A |
| 2,056,033 | 9/1936 | Biermanns | 200/148 A |
| 3,331,935 | 7/1967 | Milianowicz | 200/148 A |
| 3,739,125 | 6/1973 | Noeske | 200/148 A |

*Primary Examiner*—Robert S. Macon

*Attorney, Agent, or Firm*—Kenyon & Kenyon Reilly Carr & Chapin

[57] ABSTRACT

An arrangement for quenching an arc in a gas-flow circuit breaker in which at least one check valve is arranged in a flow canal leading through a portion of the insulating material to the quenching gap, the check valve insuring that a reverse flow from the quenching gap into the inlet canals of the quenching gas is prevented.

7 Claims, 4 Drawing Figures

ARC QUENCHING ARRANGEMENT

BACKGROUND OF THE INVENTION

This invention relates to gas flow circuit breakers in general, and more particularly to an improved arc quenching arrangement for a blast piston circuit breaker.

Arc quenching, by blowing a gaseous quenching medium at the arc to quench it, is well known in the art with a number of different circuit breaker systems having been developed using this principle.

One of these which is generally referred to as the two-pressure system, stores the quenching medium in a high-pressure tank. During the switching process, the quenching medium flows from the tank through valves, ducts and flow conduits to the quenching chamber, which is at a lower pressure. Thus, in this system, a flow results from a pressure gradient.

In what is referred to as a single-pressure system, a predetermined static pressure is maintained in the switching chamber. During the switching process, the necessary flow of quenching medium is obtained by a compression of part of the volume therein. Typical of this type of system is that known as the blast-piston circuit breakers, in which the motion of a cylinder or a piston is coupled to the motion of the circuit breaker. As the piston moves along with the opening contact, a portion of the volume of the quenching gas is compressed. At a predetermined position of the nozzle or electrode arrangement in the circuit breaker, flow cross sections are opened, permitting the flow of the quenching medium to begin.

In this type of circuit breaker, the quenching gas can interact with the arc. The arc in a gas flow circuit breaker burns between two contacts, one of which is generally a tubular contact. The flow acting against the arc takes place in a nozzle arrangement. The tubular contact can also serve as the nozzle or a separate nozzle preceding the contacts can be provided. It is a general characteristic of all circuit breaker arrangements of this type that the arc must burn through a cavity which can have the shape of a cylinder, a cone or a Laval tube and can be of different length. The arc must burn and the quenching medium must flow through this cavity which forms the nozzle. The arc will impede this flow of quenching medium. As an arc burns through a nozzle, two different zones can be distinguished: an inner, hot zone of lower density and an outer, cold zone of high density. The major portion of the total mass of the quenching means passing through the nozzle will flow through the outer, cold zone. As the arc becomes thicker, the hot zone becomes wider and the cold outer zone becomes correspondingly smaller. As a result, the mass throughput through the nozzle decreases with increasing thickness of the arc. If the arc increases in size, to fill the cross section of the nozzle completely, the mass throughput becomes a minimal.

In a-c circuit breakers, the arc current varies according to the sinuoidal shape of the half-waves of the current. When a short-circuit current is interrupted, an arc almost completely filling the cross section of the nozzle will occur at the time of maximum current. Due to the reduced mass flow, a correspondingly reduced cooling effect is obtained. As a result, the energy given up in the quenching chamber can no longer be carried off by the quenching medium. As a result of this, the pressure in the quenching chamber sharply rises. The pressure increase can lead to a situation where the inflow from the high-pressure portion of the breaker is not only reduced but, in some cases, that the direction of flow is even reversed, causing the hot gas to get into the inlet ducts. As a result, after the current decreases and normal flow direction is again resumed, a quenching medium which is heated and contaiminated with metal vapor from the electrodes will initially flow into the quenching arrangement.

Aside from the effects resulting from the hot quenching gas getting back into the inlet ducts, the pressure increase in the quenching chamber in a blast-piston type breaker can also brake the movement of the piston and with it the contact movement. As the force difference between the force driving the circuit breaker, i.e., driving the blast-piston and the circuit breaker contacts and the opposite force of the compressed gas becomes increasingly smaller, a change in direction of motion is even possible. That is to say, the piston and contacts can be driven in a direction to close rather than open the contacts. Clearly this is undesirable.

Thus, it can be seen that there is a need for an improved arrangement in a circuit breaker of this type which avoids the undesirable effects of the back pressure which can be generated when high currents are being interrupted.

SUMMARY OF THE INVENTION

The present invention solves this problem by providing in the flow conduit, in the vicinity of the quenching gap, at least one check valve arranged in a canal leading to the quenching gap through a portion of the insulating material. This valve allows flow of the quenching medium only in a direction toward the quenching gap and prevents backflow. Various possible arrangements are disclosed. It is thought advantageous to provide a plurality of check valves disposed in canals, distributed over the circumference of a portion of the insulating material serving as a lining for the quenching gap, which canals may have a circular or other cross section.

As disclosed herein, it is particularly advantageous that the canal be shaped as an annular gap extending over the entire circumference of the switching tube and sealed by a kick-back washer. With such an arrangement, the annular gap will be concentric with the quenching gap.

In another illustrated embodiment, resilient reeds are provided as check valves, sealing flow canals of corresponding cross section in the manner of reeds in musical instruments. This arrangement is particularly attractive because of the simplicity of design of the check valves. In addition, the check valves, rather than being reeds fixed at one end, can be blades hinged at one end with their open position fixed by appropriate stops.

In another disclosed arrangement, the annular gap is subdivided into individual chambers by rib-like partitions. The ribs, which are arranged behind the check valves, can be made of insulating material or of metal or a composite of these materials.

DETAILED DESCRIPTION OF THE PREFERRED EMBODIMENT

Figure 1:
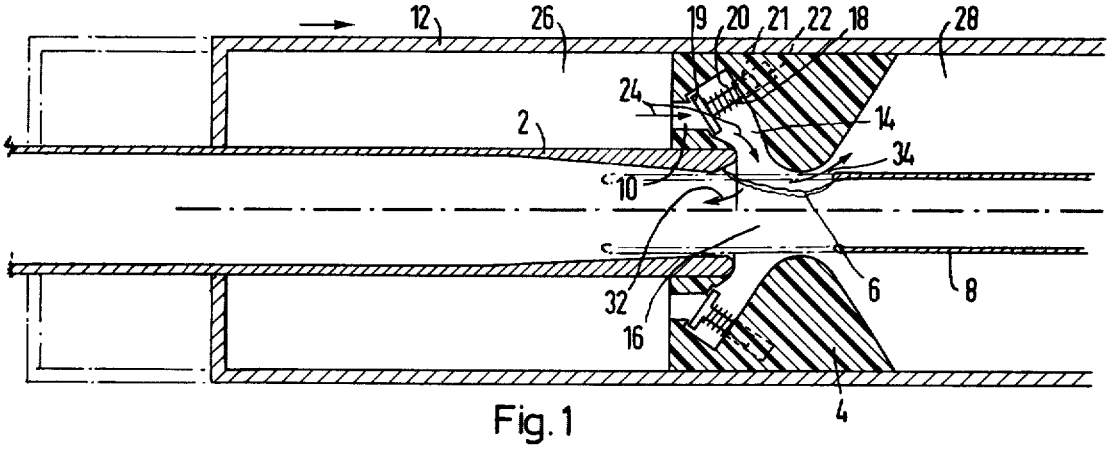
FIG. 1 is a longitudinal cross section through a blast piston circuit breaker system according to the present invention.

In the embodiment of FIG. 1, a stationary contact electrode 2 is firmly connected to a portion of insulating material 4 having a nozzle-shaped design. The shape of the insulating material 4 is such as to cause a favorable quenching flow onto an arc 6, which is drawn between the fixed electrode 2 and a movable electrode 8. In the portion of the insulating material 4, which serves to guide the quenching flow, a plurality of flow canals 10 are provided, distributed over the circumference of the insulating material. Quenching gas contained within a volume 26 is compressed by the cylinder 12 and flows through these flow canals 10 to get into the annular chamber 14 and adjoining quenching chamber 16. Cylinder 12 is closed off in a gastight manner against the contact electrode 2 and slides thereon and on a portion of the insulating material 4, which thereby serves to guide the cylinder 12. At the outlet of each of the flow canals 10, a check valve 18 is provided. This check valve permits gas flow only in a direction toward the quenching gap 16 as indicated by the arrow 24. These check valves 18 are of conventional design and need only be such as to insure that the gas can only flow in one direction. The illustrated type of valve comprises a disc valve having a sealing member 19 which is pressed against a corresponding seat surface by a spring 20. The spring 20 slides on an extension 21, supported in a hole 22 and movable in an axial direction.

It should be noted, however, that other types of flap systems can be used as the check valve, in particular those working according to the heart flap principle.

In the closed starting position shown in dotted lines, the movable electrode 8 is under an initial pressure which is the same throughout the entire system. For example, if sulfur hexafluoride is used as the quenching medium, a pressure of 6 atmg may be used. In this position, electrical contact is established between contacts 2 and 8. For opening of the breaker, conventional driving means (not shown) drive both the movable contact 8 and the blast cylinder 12 to the right in the direction of the arrow. These two elements, i.e., contact 8 and cylinder 12, are mechanically connected to move together. The movement of the cylinder 12 results in an increased pressure in the space 26 and also in the flow canals 10 and the space 14. However, up until the point where the movable electrode 8 no longer contacts the fixed electrode 2, the space 14 remains sealed off by the moving electrode 8. Thus, when this point is reached, a precompression has already taken place and when the contacts separate, quenching gas will flow from the space 26 through the flow canals and through the ring space 14 onto the arc 6 formed between the two ends of the electrodes 2 and 8. The gas flows through the electrode 2 and also, after the edge of the movable contact 8 moves past the insulating member 4, in the direction of arrow 34 into the space 28.

With this arrangement, if the current flowing in the arc 6 in the quenching chamber 16 becomes so great that the power generated can no longer be removed by the flow indicated by the arrows 32 and 34, the pressure in the quenching chamber 16 will rise. If this pressure reaches the value of the pressure in the space 26 or if it exceeds that value, the valves 18 will be pushed against their seat, closing off the space 26 so that no reverse flow can take place.

As a result, the hot gases in the quenching space which may be contaminated with metal vapor from the material of the electrodes 2 and 8, are forced to flow to the quenching chamber 16 and out through the electrode 2. In no case can they flow back into the space 26 which forms the quenching "gas tank" of the circuit breaker. Thus, during this period of over-pressure, a further compression of gas occurs in the space 26, which gas is not contaminated or heated. The drive of the piston 12 need only suppy the energy needed to obtain this compression. It does not need to act against the higher pressure in the ring space 14 and quenching chamber 16 and thus, a reduction in the capacity of the drive system over what would otherwise be required, is possible. Reverse motion of the cylinder 12 and the switching tube 8 connected therewith is impossible. As soon as the pressure in the quenching chamber 16 is reduced as a result of current reduction in the course of the half-wave, the flow from the quenching gas tank 26 resumes and new quenching gas flows into the switching gap.

In addition to obtaining improved switching properties in the a-c circuit breaker, this arrangement provides an improved design of the movable parts of the blast-piston circuit breaker in terms of dimensions.

Figure 2:
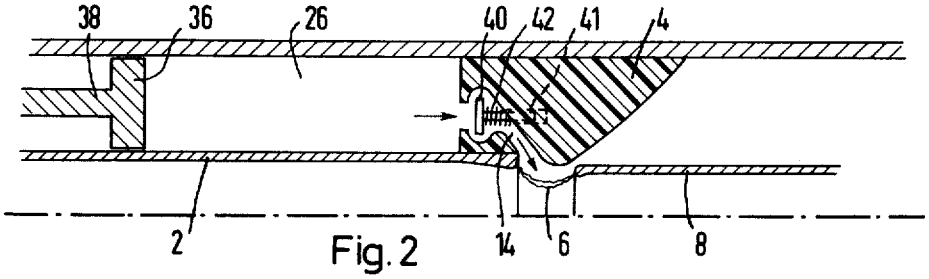
FIG. 2 is a similar view of the upper half of a similar arrangement using an annular piston and having a slightly different type of check valve.

Another particularly advantageous design is illustrated by FIG. 2, showing the upper half of a longitudinal cross section similar to FIG. 1. In this arrangement, a ring piston 36 coupled to the movable contact 8 for motion therewith is used for compressing the gas in chamber 26. In this figure, the movable contact is shown in its fully off position. In a manner similar to that described above, in connection with FIG. 1, an arc 6 is drawn between the fixed contact tube and the movable contact 8. The ring piston 36 compresses the quenching gas in the gas tank being driven, along with the contact, by a linkage of which only the rod 38 coupled to the piston 36 is shown on FIG. 2. Again, a ring canal 14 is used to direct the flow of gas onto the arc. In this embodiment, the ring canal 14 is sealed by a valve 40 which is in the form of a kick-back washer 40. The kick-back washer 40 will be an annular washer sealing an opening extending circumferencially around the insulating member 4. The washer 40 is guided by a plurality of pins 41 distributed over its circumference, on which pins coil springs are placed to generate contact pressure.

A similar arrangement can also be used in a two pressure system with the valves placed in the same manner in the inlets from the high-pressure part of the system and in the vicinity of the switching gap.

Figure 3:
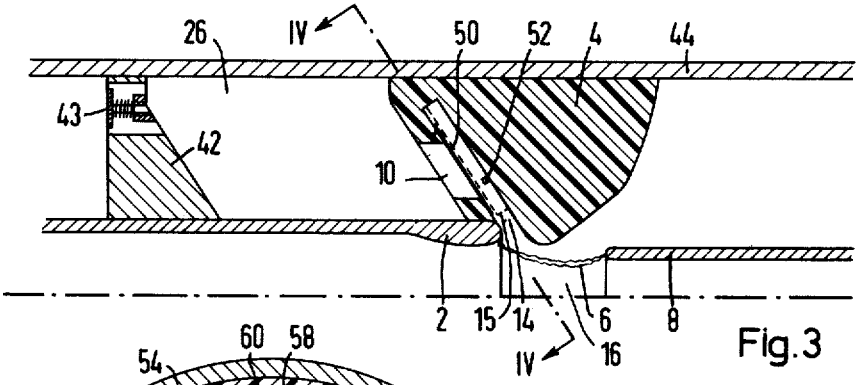
FIG. 3 is a view similar to FIG. 2, showing a different type of piston and different type of check valve.

A further embodiment of the invention is illustrated of FIG. 3. As in FIGS. 1 and 2, an arc 6 is drawn between a fixed contact 2 and a movable contact 8. Similarly, quenching gas flows through a gas flow canal 10 and a ring canal 14 which directs it onto the arc 6. A valve arrangement 50 is built into the nozzle-shaped insulating member 4. The gas flow is generated by a blast-piston 42 which is shaped so that the smallest possible dead volume is left when compressing the gas in the space 26.

The nozzle member 4, is secured within a cylindrical breaker housing part 44 and is also firmly connected to the fixed electrode 2. The piston 42 can be moved by a drive, in conventional fashion, much in the manner described above in connection with FIG. 2. Alternatively, the insulating member 4 may be ridgedly connected only with the fixed contact 2 making sliding contact with the housing 44 and the piston 42 attached to that housing. In that case, the housing and movable contact together may be moved causing the piston 42 to move therewith compressing the gas in space 26. Alternatively, the contact 2 may be made movable and moved to the left along with the insulating member 4 while the piston 42, the housing 44 and contact 8 remain fixed. In any case, the relative movement between the insulating member 4 and the piston 42 will result in the initial pressure being increased with the "tank" 26, causing it to flow through the canals 10 and into the flow canal 14, from which it is directed onto the arc burning between the electrodes 2 and 8. Typically, if sulfur hexafluoride $SF_6$ is used as the quenching gas, the initial pressure of quenching gas in the space 26 may be, for example $6 \times 10^5$ N/m$^2$.

In this embodiment, the valves 40 will preferably be springs or flaps which are pressed away from corresponding openings by the pressure in the tank 26. The amount of opening of the valves 50 can be controlled by stops 52 located on the insulating member 4. The use of these stops insures that an over pressure will properly act on the springs or flaps to close them, and prevent reverse flow. A particular advantage of this embodiment is that the movable valves 50 can be made very light thereby permitting fast opening and closing motions.

Figure 4:
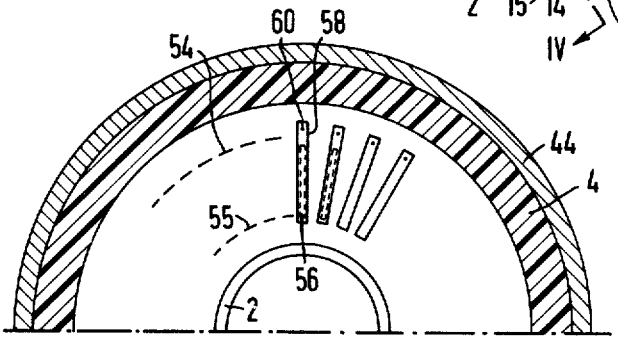
FIG. 4 is a cross sectional view along the section IV—IV of FIG. 3.

The arrangement of FIG. 3 is shown in cross section of FIG. 4. From that figure, the housing 44, fixed electrode 2 and insulating member 4 are illustrated. A plurality of openings 56 distributed circumferentially around the insulating member 4 are provided as illustrated with the openings extending between the lines 54 and 55. The total cross section of these openings which form the outlet of the canals 10 should be at least as large as the sum of the cross section within the fixed electrode 2 and the nozzle formed by the insulating member 4. In the illustrated embodiment, the closure elements 58 which are thin reed-like members are attached at one end by a screw 60 or the like. It will be recognized that they can also be clamped at this end in a suitable designed arrangement. Instead of clamping or screwing the closure elements 58 to attach them, they may instead be hinged at one end. Since their open position is fixed by the stops 52 as shown on FIG. 3, mechanical pretensioning in order to keep the openings 56 closed in the rest position of the closure elements 58 is unnecessary. Furthermore, the valve action of the closure elements 58 will not be disturbed even if some of the closure elements are open in their rest position due to the effect of gravity, since the quenching gas flowing in from the tank 26 opens all the closure elements in any case, and their closing is assured by the force of the reverse flow almost instantaneously.

When using a hinged support of the closure elements 58, the elements can be metal as well as plastic of a sufficient strength. If the elements are fastened at one end by a screw or a clamp, closure elements will preferably be made of metal, e.g., stainless steel, although resilient plastic may also be used.

On FIG. 4, closure elements 58 of approximately rectangular shape are shown. It should be noted that round, trapezoidal or other shapes of openings 56 and closure elements 58 may also be used.

An evenly distributed flow in the ring canal 14 of FIG. 3 can be obtained by a large number of relatively small openings 56. The use of many small closure elements 58 has as a further advantage that a relatively large total cross section of openings is released with a small opening stroke, i.e., a small deflection of the free ends of the closure elements 58. In place of the single closure element 58 for each of the canals 56 shown on FIG. 4, it is also possible to use several closure elements for a single canal.

Another particularly advantageous arrangement illustrated by FIG. 3 is the arrangement of ribs extending radially and in the axial direction of the overall arrangement such that the ring volume of the canal 14 is divided into individual chambers. These ribs designated as 15 on FIG. 3 may comprise plastic, an insulating material or may be made of metal. Through the use of these ribs, a uniform flow in the ring canal 14 is obtained in a direction toward the quenching chamber 16 and thus toward the arc 6.

When the breaker is closed, the quenching gas tank 26 must be refilled with quenching gas. It will be recognized that during the closing motion, the volume of the tank area 26 will be increased resulting in a reduction in pressure with respect to the remaining portion of the breaker, and will thus cause the valves 50 to close. As a result, the tank cannot be filled through the canal 14 and openings 10. To provide for refilling, the blast portion 42 is equipped with one or more check valves 43 of a design similar to the valve 50 of FIG. 3 of valves 18 of FIG. 1. Since these valves do not need to operate in a particularly fast manner, it is sufficient to use a suction valve or only a few valves of relatively large cross section.

Thus, an improved design for a gas flow type circuit breaker has been shown. Although specific embodiments have been illustrated and described, it will be obvious to those skilled in the art that various modifications may be made without departing from the spirit of the invention, which is intended to be limited solely by the appended claims.

What is claimed is:

1. In a gas-flow circuit breaker, such as a blast piston breaker, in which gas is directed from a space of higher pressure to the vicinity of a quenching gap, said breaker including a fixed contact and a movable contact which when separated from an arc in said quenching gap, an improved arrangement for quenching and arc in said gap comprising:

a. insulating material arranged to form a plurality of flow canals to direct the flow of gas from the space of higher pressure onto the quenching gap, said flow canals being evenly spaced concentric to said quenching gap; and b. a check valve in each of said canals arranged to permit flow only from the space of higher pressure toward said quenching gap.

2. An arrangement according to claim 1 wherein said plurality of check valve are installed in annular flow conduit concentrically surrounding said quenching gap.

3. An arrangement according to claim 1 wherein said check valve comprise a plurality of openings into an annular flow conduit concentrically surrounding said quenching gap with each of siad openings covered by a resilient reed.

4. An arrangement according to claim 1 wherein said check valve comprises a plurality of openings into an annular canal surrounding said quenching gap with hinged flaps covering said openings.

5. The arrangement according to claim 3 and further including radial ribs in said canal.

6. The arrangement according to claim 4 and further including radial ribs in said canal.

7. The arrangement according to claim 1 wherein a blast piston is used to generate a higher pressure in said space and further including a suction valve in said blast piston.

* * * * *

UNITED STATES PATENT OFFICE

CERTIFICATE OF CORRECTION

Patent No. 3,940,583 Dated February 24, 1976

Inventor(s) Walter Hertz

It is certified that error appears in the above-identified patent and that said Letters Patent are hereby corrected as shown below:

Col. 5, line 46, change "suitable" to --suitably--.

Col. 6, line 29, change "portion" to --piston--.

Col. 6, line 30, change "of" to --or--.

Col. 6, claim 3, line 65, change "siad" to --said--.

Signed and Sealed this

Third Day of August 1976

[SEAL]

*Attest:*

RUTH C. MASON
*Attesting Officer*

C. MARSHALL DANN
*Commissioner of Patents and Trademarks*